US011835057B2

(12) United States Patent
Fujita et al.

(10) Patent No.: US 11,835,057 B2
(45) Date of Patent: Dec. 5, 2023

(54) IMPELLER OF CENTRIFUGAL COMPRESSOR, CENTRIFUGAL COMPRESSOR, AND TURBOCHARGER

(71) Applicant: MITSUBISHI HEAVY INDUSTRIES ENGINE & TURBOCHARGER, LTD., Sagamihara (JP)

(72) Inventors: Yutaka Fujita, Tokyo (JP); Nobuhito Oka, Kanagawa (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 17/782,321

(22) PCT Filed: Dec. 9, 2019

(86) PCT No.: PCT/JP2019/047999
§ 371 (c)(1),
(2) Date: Jun. 3, 2022

(87) PCT Pub. No.: WO2021/117077
PCT Pub. Date: Jun. 17, 2021

(65) Prior Publication Data
US 2022/0389936 A1 Dec. 8, 2022

(51) Int. Cl.
*F04D 29/28* (2006.01)
*F04D 17/10* (2006.01)
(Continued)

(52) U.S. Cl.
CPC ..... *F04D 29/284* (2013.01); *F04D 17/10* (2013.01); *F04D 29/30* (2013.01); *F01D 5/048* (2013.01); *F01D 5/141* (2013.01)

(58) Field of Classification Search
CPC ..... F04D 29/284; F04D 29/30; F04D 29/286; F04D 29/324; F04D 29/384;
(Continued)

(56) References Cited

U.S. PATENT DOCUMENTS 3,890,062 A * 6/1975 Hendrix ..... F04D 29/324 416/223 R
4,006,997 A * 2/1977 Friberg ..... F04D 21/00 416/185
(Continued)

FOREIGN PATENT DOCUMENTS

CN 104653511 A 5/2015
EP 4001659 A1 * 5/2022
(Continued)

OTHER PUBLICATIONS

EP 4001659—translation from Espacenet (Year: 2022).*
(Continued)

*Primary Examiner* — Woody A Lee, Jr.
*Assistant Examiner* — Behnoush Haghighian
(74) *Attorney, Agent, or Firm* — Birch, Stewart, Kolasch & Birch, LLP

(57) ABSTRACT

An impeller of a centrifugal compressor is an impeller 5 of a centrifugal compressor, that is, a compressor impeller 5 and includes a hub, at least one airfoil portion erected on a hub surface of the hub, and a first fillet. The at least one airfoil portion has a trailing edge configured such that a distance between the trailing edge and an axis of the centrifugal compressor increases with increasing distance from a back surface of the hub. The first fillet is formed on a radially outer side of an outer peripheral surface of a back plate portion forming a back surface portion of the hub. The
(Continued)

first fillet connects the outer peripheral surface of the back plate portion and the trailing edge of the at least one airfoil portion.

7 Claims, 11 Drawing Sheets

(51) Int. Cl.
*F04D 29/30* (2006.01)
*F01D 5/14* (2006.01)
*F01D 5/04* (2006.01)

(58) Field of Classification Search
CPC ..... F04D 29/242; F04D 17/122; F04D 17/10; F04D 27/0246; F04D 27/002; F01D 5/141; F01D 5/048
See application file for complete search history.

(56) References Cited

U.S. PATENT DOCUMENTS 5,061,154 A * 10/1991 Kington ..... F01D 5/28 29/889
6,471,474 B1 * 10/2002 Mielke ..... F04D 29/321 416/198 A
6,478,539 B1 * 11/2002 Trutschel ..... F01D 5/143 415/223
6,905,310 B2 * 6/2005 Kawamoto ..... F04D 29/284 416/175
6,942,460 B2 * 9/2005 Osako ..... F02B 39/00 416/185
7,476,081 B2 * 1/2009 Higashimori ..... F04D 29/30 416/185
7,896,618 B2 * 3/2011 Higashimori ..... F04D 29/30 416/185
8,128,356 B2 * 3/2012 Higashimori ..... F01D 17/148 415/205
8,721,287 B2 * 5/2014 Billotey ..... F04D 29/284 415/206
9,404,506 B2 * 8/2016 Masutani ..... F04D 29/30
9,657,573 B2 * 5/2017 Higashimori ..... F01D 5/141
9,951,787 B2 * 4/2018 De Santis ..... F04D 29/284
10,641,282 B2 * 5/2020 Hayamitsu ..... F04D 29/384
10,941,662 B2 * 3/2021 Keating ..... F01D 5/048
11,215,057 B2 * 1/2022 Yoshida ..... F01D 5/141
2008/0229742 A1 9/2008 Renaud et al.
2009/0290980 A1 * 11/2009 Higashimori ..... F02B 37/22 415/205
2010/0322781 A1 * 12/2010 Heyes ..... F04D 29/284 416/244 A
2015/0125302 A1 * 5/2015 Roberto ..... F04D 17/00 416/183
2015/0218949 A1 * 8/2015 Higashimori ..... F01D 1/026 415/205

FOREIGN PATENT DOCUMENTS

JP 4-132898 A 5/1992
JP 2006-226199 A 8/2006
JP 2009-221984 A 10/2009
JP 2011-512479 A 4/2011
JP 2015-194091 A 11/2015

OTHER PUBLICATIONS

International Preliminary Report on Patentability and Written Opinion of the International Searching Authority for International Application No. PCT/JP2019/047999, dated Jun. 23, 2022, with English translation.
International Search Report for International Application No. PCT/JP2019/047999, dated Feb. 10, 2020.

* cited by examiner

IMPELLER OF CENTRIFUGAL COMPRESSOR, CENTRIFUGAL COMPRESSOR, AND TURBOCHARGER

TECHNICAL FIELD

The present disclosure relates to an impeller of a centrifugal compressor, the centrifugal compressor, and a turbocharger.

BACKGROUND

For example, a turbocharger is known as a turbo device for improving an output of an engine by utilizing energy of an exhaust gas discharged from the engine. The turbocharger rotary drives a turbine impeller by the exhaust gas discharged from the engine, thereby rotary driving a compressor impeller coaxially connected to the turbine impeller to compress intake air and supplying the compressed intake air to the engine (see, for example, Patent Document 1).

CITATION LIST

Patent Literature

Patent Document 1: JP2015-194091A

SUMMARY

Technical Problem

In recent years, there has been a demand for a high compression ratio of a compressor, and in order to achieve the high compression ratio, a high peripheral speed of a compressor impeller (impeller) is required.

In order to increase the peripheral speed of the impeller, it is conceivable to change the shape of a trailing edge of an airfoil portion, in addition to increasing a rotation speed of the impeller.

For example, in the centrifugal compressor disclosed in Patent Document 1 described above, a part of a trailing edge of an airfoil is projected radially outward relative to a maximum diameter portion of a hub of an impeller, thereby increasing the peripheral speed at the trailing edge.

However, simply projecting a part of the trailing edge of the airfoil radially outward relative to the maximum diameter portion of the hub of the impeller may lead to an increase in stress due to a centrifugal force acting on the airfoil portion and a decrease in natural frequency of the airfoil portion.

In view of the above, an object of at least one embodiment of the present disclosure is to increase the compression ratio of the centrifugal compressor while ensuring durability of the centrifugal compressor.

Solution to Problem (1) An impeller of a centrifugal compressor according to at least one embodiment of the present disclosure includes a hub, at least one airfoil portion erected on a hub surface of the hub, the at least one airfoil portion having a trailing edge configured such that a distance between the trailing edge and an axis of the centrifugal compressor increases with increasing distance from a back surface of the hub, and a first fillet which is formed on a radially outer side of an outer peripheral surface of a back plate portion forming a back surface portion of the hub, the first fillet connecting the outer peripheral surface and the trailing edge of the at least one airfoil portion.

(2) A centrifugal compressor according to at least one embodiment of the present disclosure includes the impeller of the centrifugal compressor as defined in the above (1), and a compressor housing for housing the impeller.

(3) A turbocharger according to at least one embodiment of the present disclosure includes the centrifugal compressor as defined in the above (2).

Advantageous Effects

According to at least one embodiment of the present disclosure, it is possible to increase the compression ratio of a centrifugal compressor while ensuring durability of the centrifugal compressor.

DETAILED DESCRIPTION

Figure 1:
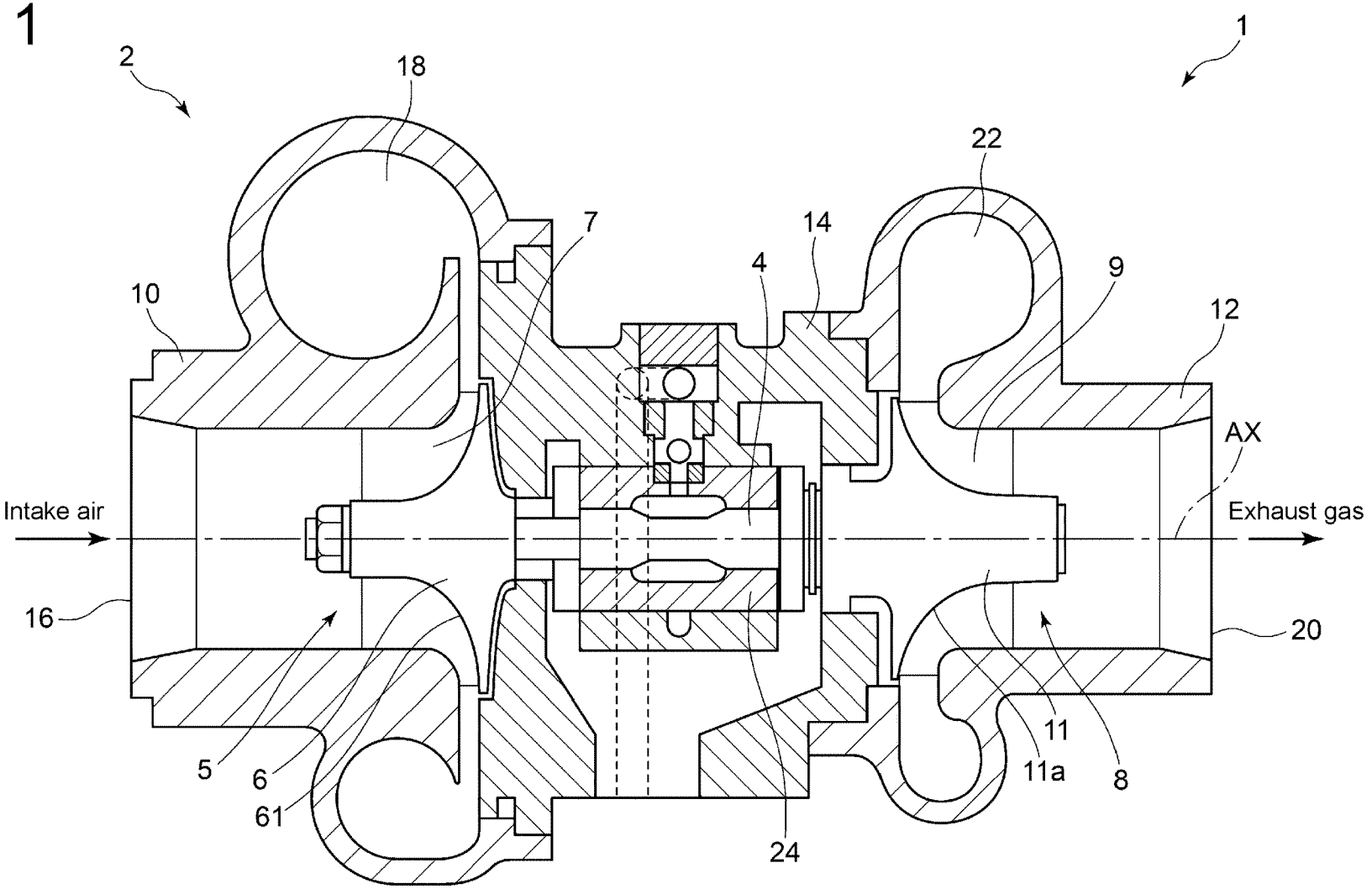
FIG. 1 is a schematic cross-sectional view of a turbocharger according to some embodiments.

Embodiments of the present disclosure will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a tubular shape shall not be construed as only the geometrically strict shape, but also includes a shape with unevenness or chamfered corners within the range in which the same effect can be achieved.

On the other hand, the expressions "comprising", "including", "having", "containing", and "constituting" one constituent component are not exclusive expressions that exclude the presence of other constituent components.

(Overall Configuration of Turbocharger 1)

First, with reference to FIG. 1, a turbocharger which is provided with a centrifugal compressor including an impeller according to some embodiments will be described. FIG. 1 is a schematic cross-sectional view of the turbocharger according to some embodiments. As shown in the figure, a turbocharger 1 is provided with a centrifugal compressor 2 including a compressor impeller 5. The turbocharger 1 includes a rotational shaft 4, a compressor impeller 5 (impeller 5) disposed on one end portion of the rotational shaft 4, a turbine impeller 8 disposed on another end portion of the rotational shaft 4, and a bearing 24 for rotatably instructing the rotational shaft 4. The bearing 24 is located between the compressor impeller 5 and the turbine impeller 8 in the axial direction of the rotational shaft 4. Although not particularly limited, the turbocharger 1 according to some embodiments is a turbocharger mounted on, for example, an automobile engine or the like.

The compressor impeller 5 includes a hub 6, and a plurality of airfoil portions 7 erected on a hub surface 61 of the hub 6. The turbine impeller 8 includes a hub 11, and a plurality of airfoils 9 erected on a hub surface 11*a* of the hub 11. The rotational shaft 4, the compressor impeller 5, and the turbine impeller 8 have a common central axis AX.

Further, the turbocharger 1 includes a compressor housing 10 for housing the compressor impeller 5, a turbine housing 12 for surrounding the turbine impeller 8, and a bearing housing 14 located between the compressor housing 10 and the turbine housing 12 in the axial direction of the rotational shaft 4. The compressor housing 10 and the bearing housing 14, and the turbine housing 12 and the bearing housing 14 may be fastened by bolts (not shown), respectively.

The compressor housing 10 includes an air inlet 16 opening axially outward in one end portion of the turbocharger 1 in the axial direction, and forms an annular flow passage 18 located on the radially outer side of the compressor impeller 5.

Moreover, the turbine housing 12 includes an exhaust gas outlet 20 opening axially outward in another end portion of the turbocharger 1 in the axial direction, and forms an annular flow passage 22 located on the radially outer side of the turbine impeller 8.

The turbocharger 1 having the above-described configuration operates as follows, for example.

Air flows into the compressor impeller 5 via the air inlet 16, and the air is compressed by the compressor impeller 5 rotating with the rotational shaft 4. The thus generated compressed air is temporarily discharged from the turbocharger 1 via the annular flow passage 18 formed on the radially outer side of the compressor impeller 5 and is supplied to, for example, a combustion engine (not shown).

In the combustion engine, fuel is combusted with the above-described compressed air, and a combustion gas is generated by this combustion reaction. The combustion gas flows into the turbine impeller 8 via the annular flow passage 22 formed on the radially outer side of the turbine impeller 8, as an exhaust gas discharged from the combustion engine. The flow of the above-described inflow exhaust gas applies a rotational force to the turbine impeller 8, thereby driving the rotational shaft 4. The exhaust gas having finished work in the turbine is discharged from the turbocharger 1 via the exhaust gas outlet 20.

(Regarding Compressor Impeller 5 (Impeller 5))

Next, the compressor impeller 5 (impeller 5) according to some embodiments will be described more specifically.

Figure 2:
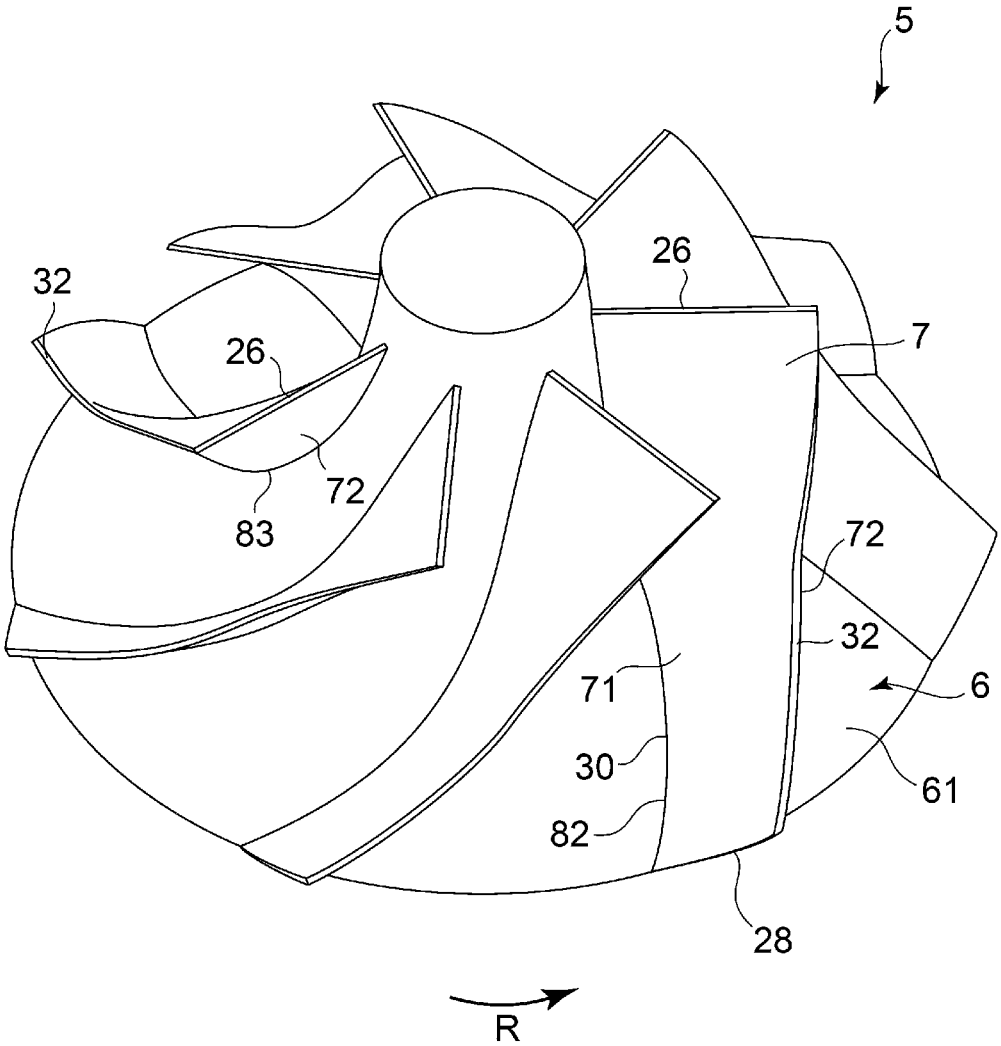
FIG. 2 is a schematic perspective view of an impeller according to an embodiment.

FIG. 2 is a schematic perspective view of the impeller according to an embodiment.

Figure 3:
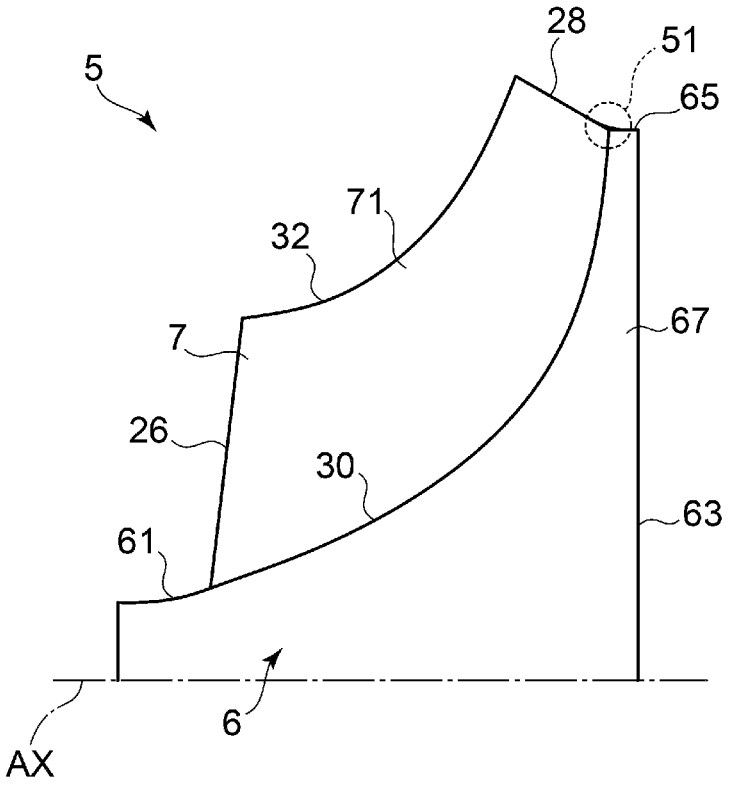
FIG. 3 is a schematic view showing a schematic meridional cross-section of the impeller according to an embodiment.

FIG. 3 is a schematic view showing a schematic meridional cross-section of the impeller according to an embodiment.

Since the basic configuration of the impeller 5 according to another embodiment described later is the same as that of the impeller 5 according to an embodiment, in the following description, the impeller 5 according to an embodiment and the impeller 5 according to another embodiment will be described with reference to FIGS. 2 and 3.

As shown in FIGS. 2 and 3, in the impeller 5 according to some embodiments, each of the plurality of airfoil portions 7 disposed around the hub 6 of the impeller 5 extends between a leading edge 26 located on a most upstream side and a trailing edge 28 located on a most downstream side in a flow direction of a fluid flowing into the impeller 5, and between a hub side end 30 and a shroud side end (tip end) 32. The hub side end 30 corresponds to a position of the airfoil portion 7 connected to the hub 6. The shroud side end 32 is an end located opposite to the hub side end 30 and is located adjacent to the compressor housing 10 (see FIG. 1).

In the impeller 5 according to some embodiments, the hub 6 includes a back plate of the impeller 5, that is, a back plate portion forming a back surface portion of the hub 6. In the following description, the back plate portion will also be referred to as a back plate portion 67.

In the impeller 5 according to some embodiments, a surface on a back surface side of the back plate portion 67 is a back surface 63 of the hub 6. The back plate portion 67 has an outer peripheral surface 65 which is a radially outer surface of the back plate portion 67. In the impeller 5 according to some embodiments, each of the plurality of airfoil portions 7 is inclined so as to tilt toward the side of a pressure surface 72. That is, each of the plurality of airfoil portions 7 is formed to gradually be directed from the side of a suction surface 71 to the side of the pressure surface 72, toward the shroud side end 32 from the hub side end 30.

In the following description, when a rotational direction of the impeller 5 is illustrated, it is represented by an arrow R.

Figure 4A:
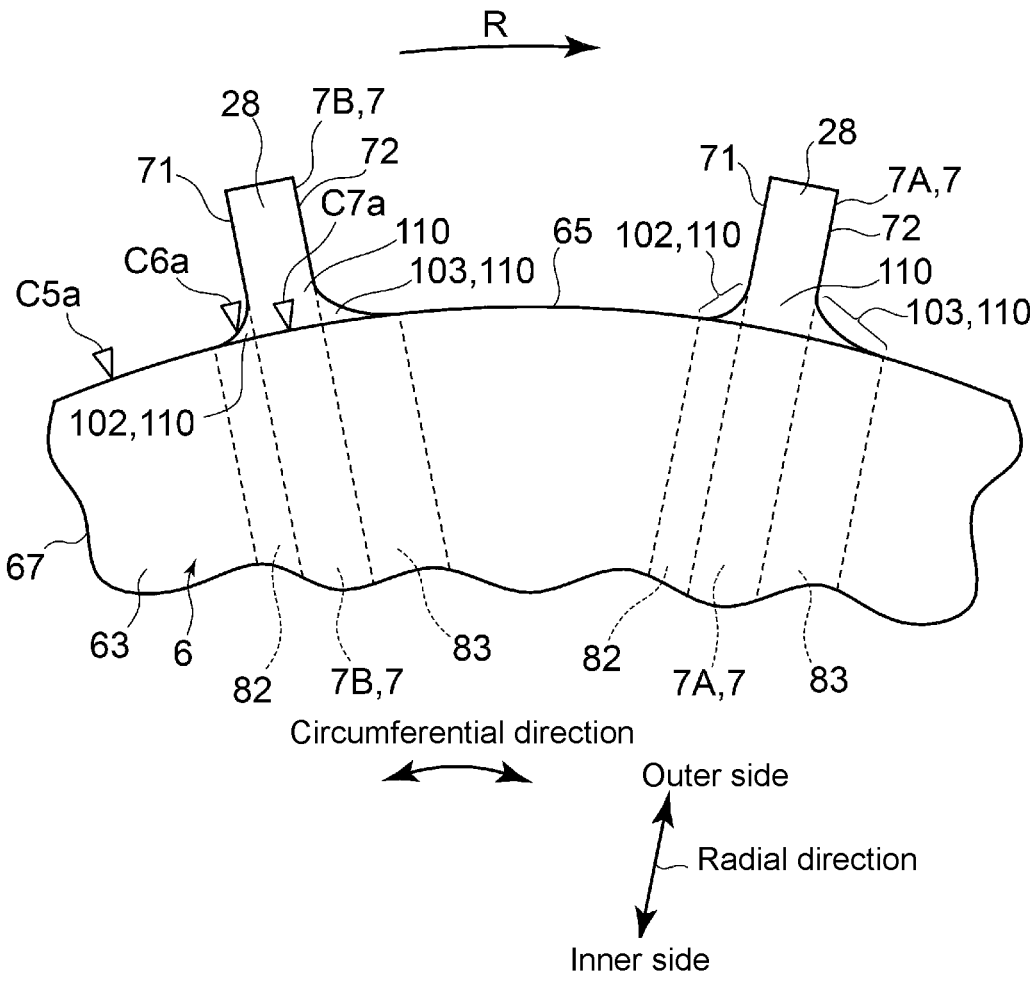
FIG. 4A is a view schematically showing a part of the impeller on an outer peripheral side when the impeller is viewed from a back surface according to an embodiment.

FIG. 4A is a view schematically showing a part of the impeller on an outer peripheral side when the impeller is viewed from a back surface according to an embodiment.

Figure 4B:
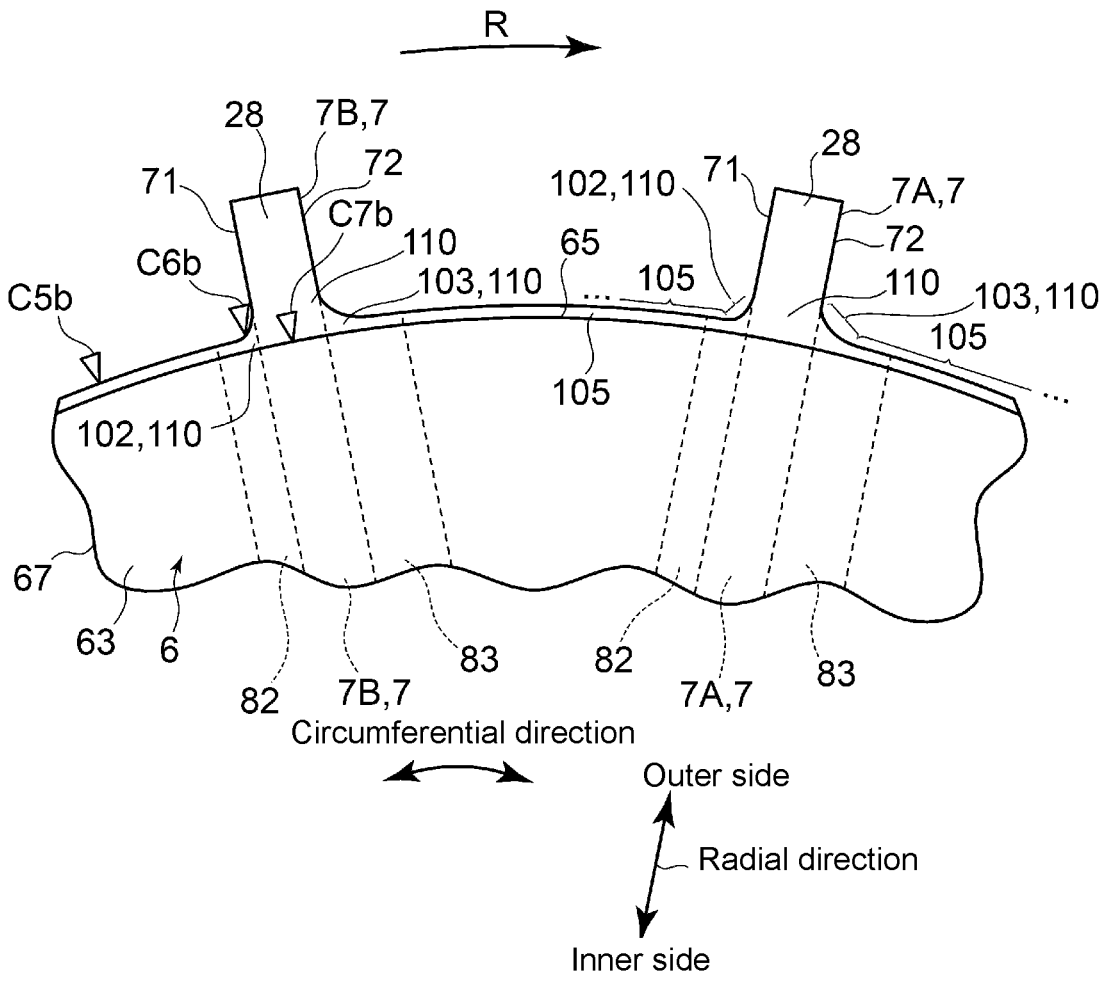
FIG. 4B is a view schematically showing a part of the impeller on the outer peripheral side when the impeller is viewed from the back surface according to another embodiment.

FIG. 4B is a view schematically showing a part of the impeller on the outer peripheral side when the impeller is viewed from the back surface according to another embodiment.

As described above, each of the plurality of airfoil portions 7 is inclined so as to tilt toward the side of the pressure surface 72. However, in FIGS. 4A and 4B, for convenience, the airfoil portion 7 is represented without reflecting the above-described inclination of the airfoil portion 7.

Figure 5A:
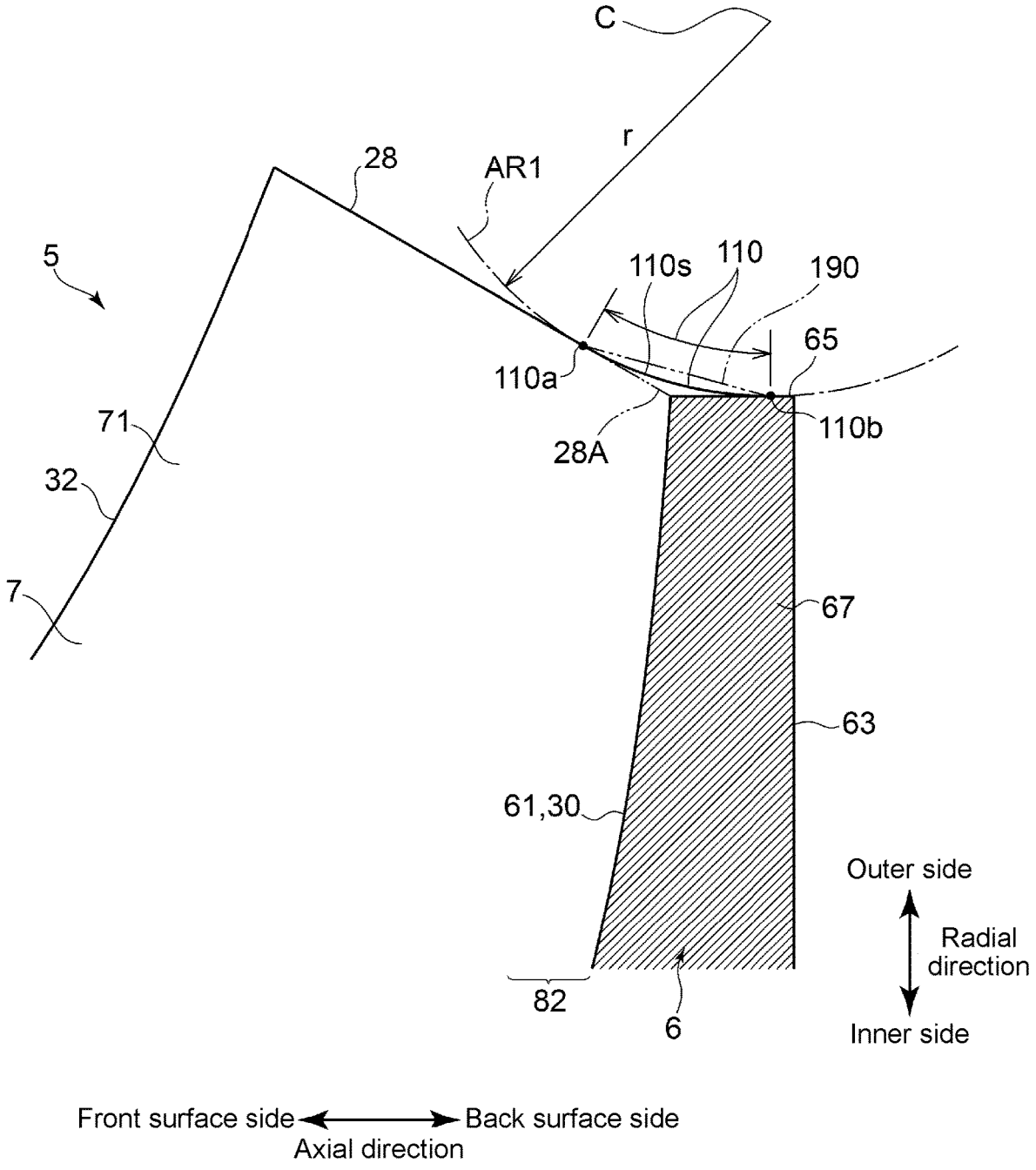
FIG. 5A is a schematic meridional cross-sectional view of the impeller according to an embodiment.

FIG. 5A is a schematic meridional cross-sectional view of the impeller according to an embodiment, and shows a case where the suction surface of the airfoil portion is viewed from a first angular position C5*a* which is an angular position of the back plate portion in FIG. 4A.

Figure 5B:
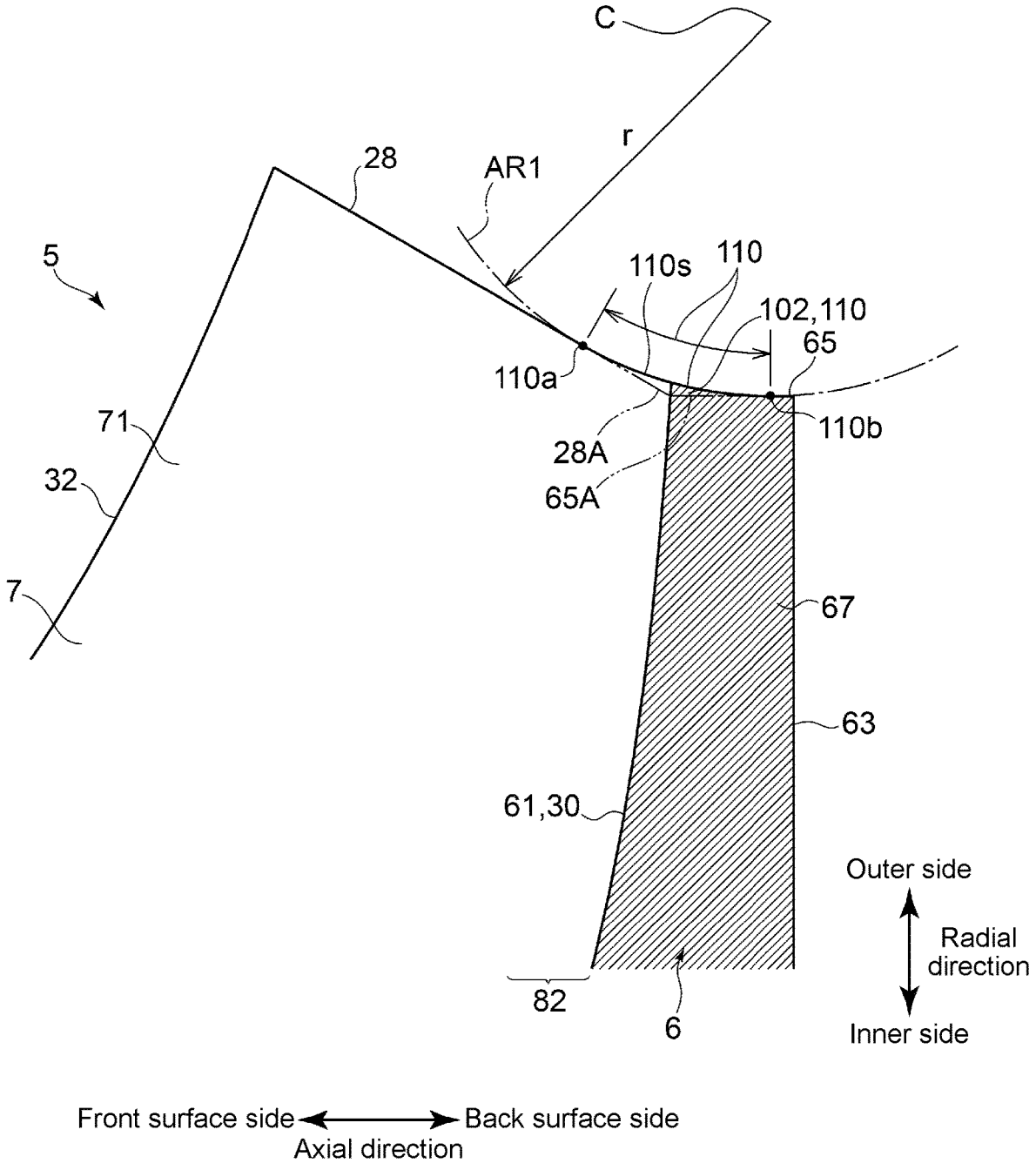
FIG. 5B is a schematic meridional cross-sectional view of the impeller according to another embodiment.

FIG. 5B is a schematic meridional cross-sectional view of the impeller according to another embodiment, and shows a case where the suction surface of the airfoil portion is viewed from a first angular position C5*b* which is an angular position of the back plate portion in FIG. 4B.

Figure 6A:
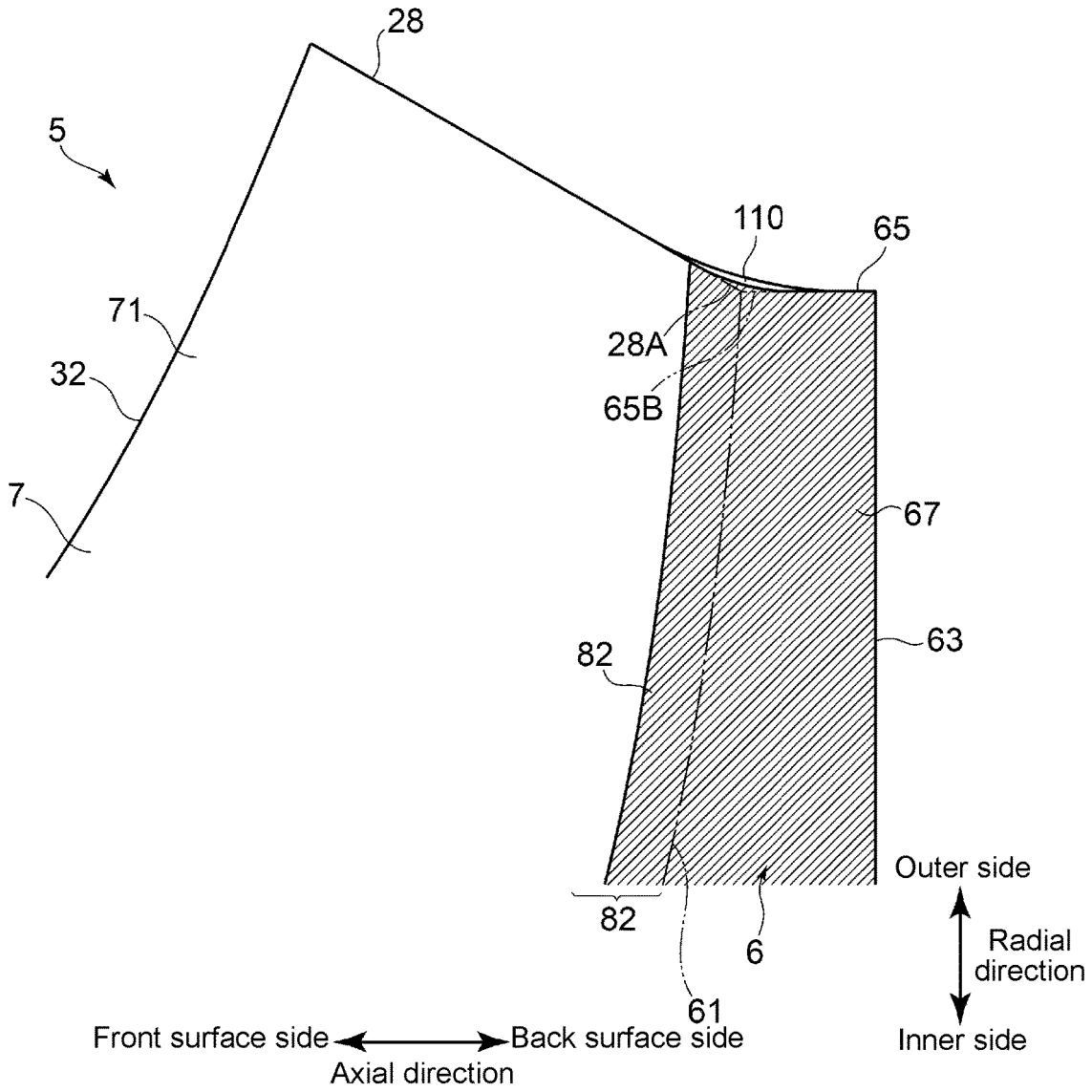
FIG. 6A is a schematic meridional cross-sectional view of the impeller according to an embodiment.

FIG. 6A is a schematic meridional cross-sectional view of the impeller according to an embodiment, and shows a case where the suction surface of the airfoil portion is viewed from a second angular position C6*a* which is an angular position of the back plate portion in FIG. 4A.

Figure 6B:
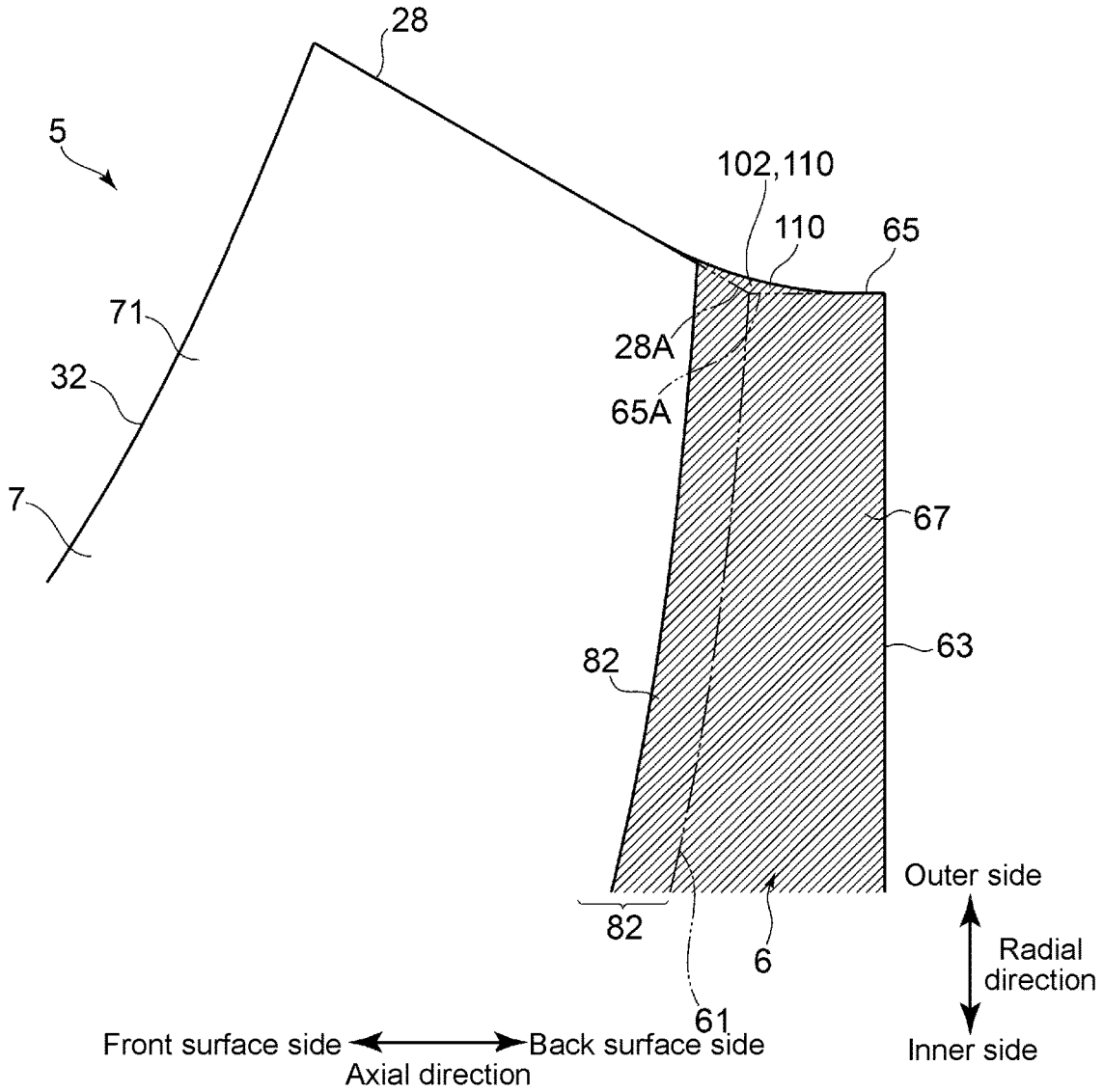
FIG. 6B is a schematic meridional cross-sectional view of the impeller according to another embodiment.

FIG. 6B is a schematic meridional cross-sectional view of the impeller according to another embodiment, and shows a case where the suction surface of the airfoil portion is viewed from a second angular position C6*b* which is an angular position of the back plate portion in FIG. 4B.

Figure 7:
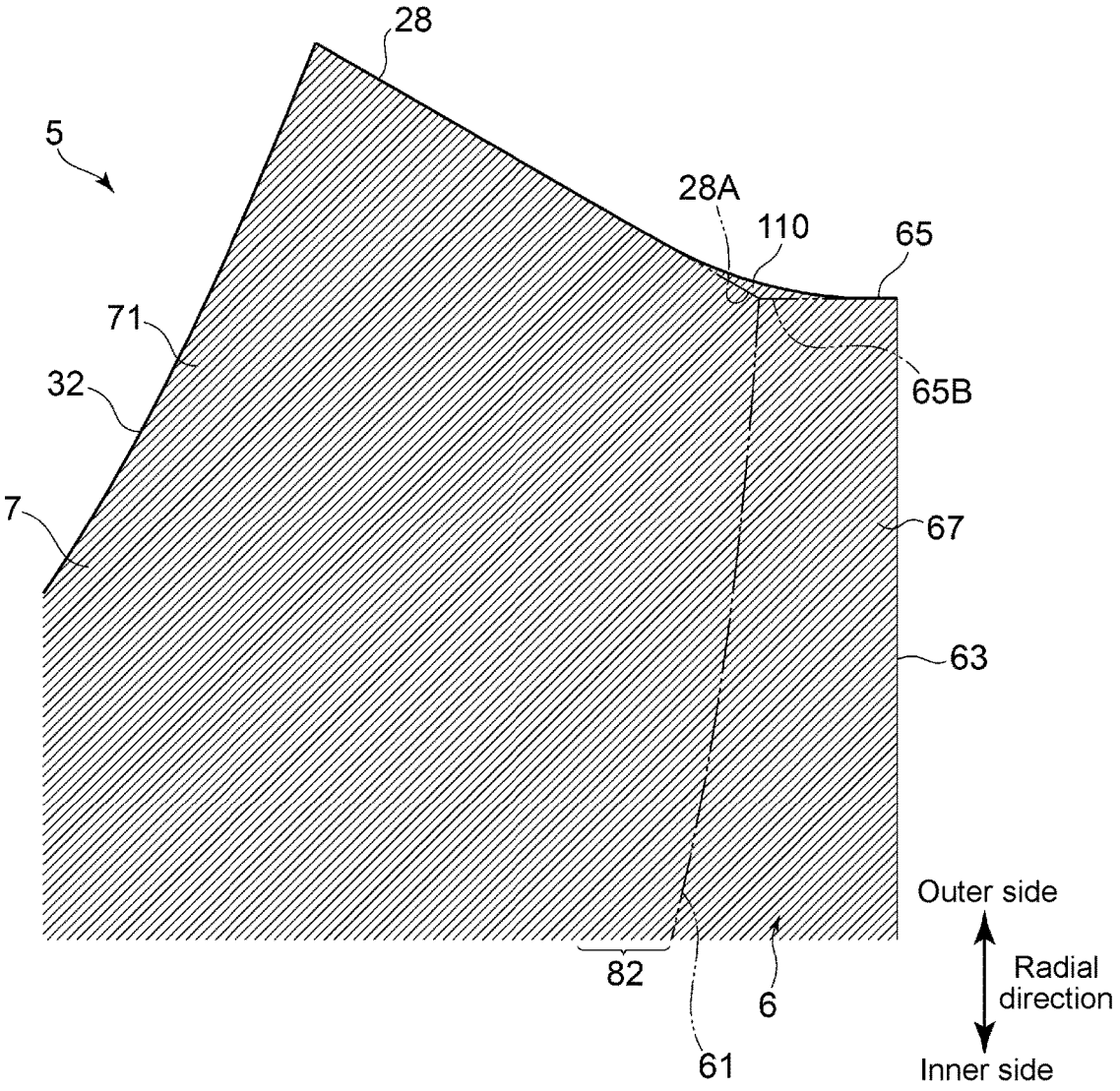
FIG. 7 is a schematic meridional cross-sectional view of the impeller according to an embodiment.

FIG. 7 is a schematic meridional cross-sectional view of the impeller according to an embodiment, and is a meridional cross-sectional view at a third angular position C7*a* which is an angular position of the back plate portion in FIG. 4A. A meridional cross-sectional view at a third angular position C7*b*, which is an angular position of the back plate portion 67 in FIG. 4B, is the same as the meridional cross-sectional view at the third angular position C7*a* shown in FIG. 4A, and thus in the following description, other embodiments will also be described with reference to the meridional cross-sectional view of FIG. 7.

A difference between the impeller 5 according to an embodiment shown in FIGS. 4A, 5A, and 6A and the impeller 5 according to the another embodiment shown in FIGS. 4B, 5B, and 6B is mainly the presence or absence of an inter-airfoil fillet 105 described later.

In the impeller 5 according to some embodiments, as shown in FIGS. 4A, 4B, 5A, 5B, 6A, 6B and 7, in order to improve the pressure ratio in the centrifugal compressor 2 by improving the peripheral speed at the trailing edge 28, the vicinity of the trailing edge 28 of the airfoil portion 7 is projected radially outward from the outer peripheral surface 65 of the back plate portion 67. More specifically, in the impeller 5 according to some embodiments, as shown in FIGS. 5A, 5B, 6A, 6B and 7, each of the airfoil portions 7 has the trailing edge 28 configured such that a distance between the trailing edge 28 and the central axis (axis) AX of the centrifugal compressor 2 increases with increasing distance from the back surface 63 of the hub 6. In the impeller 5 according to some embodiments, as shown in FIGS. 5A, 5B, 6A, 6B and 7, the trailing edge 28 is formed such that the distance between the trailing edge 28 and the axis AX (see FIG. 3) is the shortest at a position of the back plate portion 67 connected to the outer peripheral surface 65 and the distance between the trailing edge 28 and the axis AX gradually increases toward a front surface side (a left side in the figure) along the axis AX.

In the following description, with respect to a direction along the axis AX in the impeller 5, a direction from the leading edge 26 to the back surface 63 will be referred to as an axial back surface side, or simply be referred to as a back surface side, and a direction from the back surface 63 to the leading edge 26 will be referred to as an axial front surface side, or simply be referred to as a front surface side.

In the impeller 5 according to some embodiments, as shown in FIGS. 3, 4A, 4B, 5A, 5B, 6A, 6B and 7, in order to increase the peripheral speed of the impeller 5, the entire trailing edge 28 projects radially outward from the outer peripheral surface 65 of the back plate portion 67. Not the entire trailing edge 28 but a part of the trailing edge 28 may be projected radially outward from the outer peripheral surface 65 of the back plate portion 67.

If the vicinity of the trailing edge 28 of the airfoil portion 7 is projected radially outward from the outer peripheral surface 65 of the back plate portion 67 as in the impeller 5 according to some embodiments, the vicinity of the trailing edge 28 of the airfoil portion 7 is separated from the hub surface 61, which may cause a decrease in natural frequency of the airfoil portion 7. Further, if the vicinity of the trailing edge 28 of the airfoil portion 7 is projected radially outward from the outer peripheral surface 65 of the back plate portion 67 as in the impeller 5 according to some embodiments, due to a centrifugal force acting on a portion projecting radially outward from the outer peripheral surface 65 of the back plate portion 67, a stress generated in the airfoil portion 7 increases as compared with a case without the above-described portion.

Thus, the impeller 5 according to some embodiments includes the following configuration.

That is, as shown in FIGS. 4A, 4B, 5A, 5B, 6A, 6B and 7, the impeller 5 according to some embodiments includes a first fillet 110 connecting the trailing edge 28 and the outer peripheral surface 65 of the back plate portion 67. As shown in FIGS. 4A, 4B, 5A, 5B, 6A, 6B and 7, the first fillet 110 according to some embodiments is formed on a radially outer side of the outer peripheral surface 65 of the back plate portion 67 forming the back surface portion of the hub 6. As shown in FIGS. 5A, 5B, 6A, 6B and 7, the first fillet 110 according to some embodiments smoothly connects the trailing edge 28 and the outer peripheral surface 65 of the back plate portion 67. Thus, in the meridional view, a section where an angle changes suddenly does not occur in a connection portion 51 (see FIG. 3) between the trailing edge 28 and the outer peripheral surface 65 of the back plate portion 67.

In the impeller 5 according to some embodiments, the first fillet 110 can be formed so as to connect the trailing edge 28 and the outer peripheral surface 65 of the back plate portion 67 within a range excluding a range that overlaps with at least a second fillet 82 and a third fillet 83 described later, when the impeller 5 is viewed from the radially outer side.

The shape of the trailing edge 28 in a case without the first fillet 110 is indicated by a double-dotted chain line as a virtual trailing edge 28A in FIGS. 5A, 5B, 6A and 6B, for example.

In the impeller 5 according to an embodiment, as shown in FIGS. 5A and 6A, an end portion of the virtual trailing edge 28A on the side of the hub 6 (back surface side) contacts a front surface side-edge portion of the outer peripheral surface 65 of the back plate portion 67, that is, a radially outer edge portion of the hub surface 61. In FIG. 6A, a position of the outer peripheral surface 65 when it is assumed that the first fillet 110 is not formed is represented by a double-dotted chain line 65B.

Further, in the impeller 5 according to the another embodiment, as shown in FIGS. 5B and 6B, the end portion of the virtual trailing edge 28A on the side of the hub 6 (back surface side) contacts a front surface side-edge portion of a virtual outer peripheral surface 65A which is assumed that the inter-airfoil fillet 105 described later is not provided.

In the impeller 5 according to some embodiments, as shown in FIGS. 4A, 4B, 5A, 5B, 6A, 6B and 7, since the first fillet 110 connects the trailing edge 28 of the airfoil portion 7 and the outer peripheral surface 65 of the back plate portion 67, it is possible to improve rigidity of the airfoil portion 7 in the vicinity of the trailing edge 28. Thus, it is possible to suppress the decrease in natural frequency of the airfoil portion 7 while increasing the peripheral speed of the impeller. Further, in the impeller 5 according to some embodiments, as shown in FIGS. 4A, 4B, 5A, 5B, 6A, 6B and 7, since the first fillet 110 can bear a part of the above-described stress, it is possible to suppress the stress on the airfoil portion 7 in the vicinity of the trailing edge 28. Therefore, with the impeller 5 according to some embodiments shown in FIGS. 4A, 4B, 5A, 5B, 6A, 6B, and 7, it is possible to ensure the durability of the impeller 5 while increasing the peripheral speed of the impeller.

Further, with the impeller 5 according to some embodiments shown in FIGS. 4A, 4B, 5A, 5B, 6A, 6B and 7, in a case where the impeller 5 is manufactured by machining, it is possible to mitigate the sudden change in angle from the trailing edge 28 to the outer peripheral surface 65 of the back plate portion 67 when cutting from the trailing edge 28 to the outer peripheral surface 65 of the back plate portion 67, facilitating processing.

In some embodiments, as shown in FIGS. 4A and 4B, the impeller 5 further includes the second fillet 82 connecting the hub surface 61 and the suction surface 71 of the airfoil portion 7, and the third fillet 83 connecting the hub surface 61 and the pressure surface 72 of the airfoil portion 7. The first fillet 110 includes a fillet portion on suction surface 102 connecting the second fillet 82 and the outer peripheral surface 65 of the back plate portion 67, and a fillet portion on pressure surface 103 connecting the third fillet 83 and the outer peripheral surface 65 of the back plate portion 67.

As described above, if the vicinity of the trailing edge 28 of the airfoil portion 7 is projected radially outward from the outer peripheral surface 65 of the back plate portion 67, due to the centrifugal force acting on the portion projecting radially outward from the outer peripheral surface 65 of the back plate portion 67, the stress generated in the airfoil portion 7 increases as compared with the case without the above-described portion. However, in some embodiments, as shown in FIGS. 4A and 4B, since the fillet portion on suction surface 102 and the fillet portion on pressure surface 103 can also bear a part of the stress generated in the airfoil portion 7, it is possible to further suppress the stress on the airfoil portion 7 in the vicinity of the trailing edge 28.

Further, in some embodiments, as shown in FIGS. 4A and 4B, since the first fillet 110 includes the fillet portion on suction surface 102 and the fillet portion on pressure surface 103, it is possible to further improve rigidity of the airfoil portion 7 in the vicinity of the trailing edge 28. Thus, it is possible to further suppress the decrease in natural frequency of the airfoil portion 7.

In some embodiments, as shown in FIGS. 4A and 4B, a circumferential length of the fillet portion on pressure surface 103 is greater than a circumferential length of the fillet portion on suction surface 102.

In the case where the impeller 5 is manufactured by machining, if the airfoil portion 7 is formed to be inclined toward the side of the pressure surface 72, it is easy to insert a tool used for cutting between the hub surface 61 and the suction surface 71 of the airfoil portion 7, but it is difficult to insert the tool between the hub surface 61 and the pressure surface 72 of the airfoil portion 7. Thus, despite an attempt to reduce the thickness of the second fillet 82 and the third fillet 83 as much as possible, the third fillet 83 is more likely to remain thick than the second fillet 82, and the circumferential length of the third fillet 83 is likely to be greater than that of the second fillet 82. Therefore, if the fillet portion on suction surface 102 and the fillet portion on pressure surface 103 are respectively formed in accordance with the shapes of the second fillet 82 and the third fillet 83, the circumferential length of the fillet portion on pressure surface 103 is likely to be greater than the circumferential length of the fillet portion on suction surface 102. On the contrary, in order to make the circumferential length of the fillet portion on pressure surface 103 less than the circumferential length of the fillet portion on suction surface 102, it takes time and effort for processing. Therefore, according to some embodiments, processing becomes easy.

(Regarding Inter-Airfoil Fillet 105)

In the impeller 5 according to some embodiments, for example, as shown in FIGS. 4A and 4B, the airfoil portion 7 includes a first airfoil portion 7A and a second airfoil portion 7B adjacent to the first airfoil portion 7A at an interval in the circumferential direction on the side of the suction surface 71 of the first airfoil portion 7A. Then, as shown in FIGS. 4B and 5B, the impeller 5 according to the another embodiment further includes the inter-airfoil fillet 105 which connects the fillet portion on suction surface 102 formed on the side of the suction surface 71 of the first airfoil portion 7A and the fillet portion on pressure surface 103 formed on the side of the pressure surface 72 of the second airfoil portion 2B, on the outer peripheral side of the back plate portion 67.

In a case where the impeller 5 is formed by cutting work, if the outer circumference is cut while rotating the impeller 5 around the axis AX, the inter-airfoil fillet 105 is also formed in the outer peripheral portion of the back plate portion 67 when the first fillet 110 is formed. If the inter-airfoil fillet 105 is not provided, it is necessary to remove the inter-airfoil fillet 105 by cutting or the like in the case where the inter-airfoil fillet 105 is formed as described above.

Therefore, with the impeller 5 according to the another embodiment, the impeller 5 is processed easily as compared with the case without the inter-airfoil fillet 105.

If the impeller 5 is formed by cutting work as described above, the inter-airfoil fillet 105 does not project to the side of the hub surface 61.

(Regarding Shape of First Fillet 110)

Figure 8:
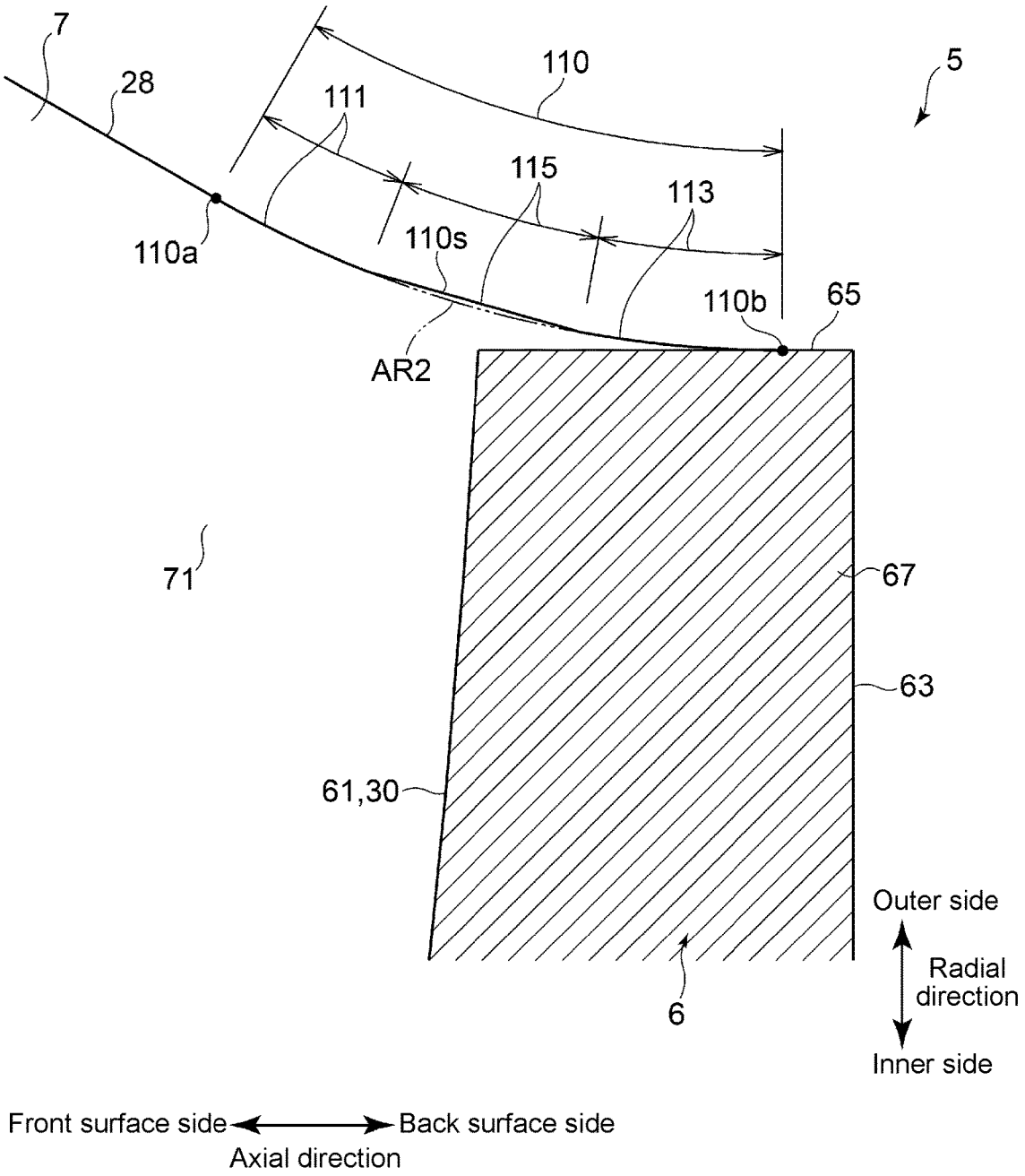
FIG. 8 is a schematic meridional cross-sectional view for describing another embodiment regarding the shape of a first fillet.

The shape of the first fillet 110 will be described mainly with reference to FIGS. 5A, 5B, and 8. FIG. 8 is a schematic meridional cross-sectional view for describing another embodiment regarding the shape of the first fillet, and shows a case where the suction surface of the airfoil portion is viewed from the first angular position C5*a* which is the angular position of the back plate portion in FIG. 4A. FIGS. 5A, 5B, and 8 each show the range of the first fillet 110 by an auxiliary line.

In some embodiments, as shown in FIGS. 5A, 5B, and 8, at least a part of the first fillet 110 has a curved shape in which a center of curvature C exists on the radially outer side of the outer peripheral surface 65, in a meridional cross-section of the impeller 5. That is, for example, in the impeller 5 according to an embodiment, as shown in FIG. 5A, 5B, the first fillet 110 forms the curved shape from a first end surface 110*a* on the side of the trailing edge 28 to a second end surface 110*b* on the side of the outer peripheral surface 65 in the meridional cross-section of the impeller 5. In the embodiment shown in FIG. 5A, 5B, the first fillet 110 is formed along one arc AR1 centered on the one center of curvature C in the meridional cross-section of the impeller 5. However, the curvature may change between the first end surface 110*a* and the second end surface 110*b*.

Further, as in the embodiment shown in FIG. 8 described later, in the meridional cross-section of the impeller 5, if the first fillet 110 includes a first curved portion 111, a second curved portion 113, and a straight portion 115 from the first end surface 110*a* to the second end surface 110*b*, the curvature may be the same or may be different between the first curved portion 111 and the second curved portion 113.

Since at least a part of the first fillet 110 has the curved shape in which the center of curvature C exists on the radially outer side of the outer peripheral surface 65 in the meridional cross-section of the impeller 5, as compared with a case without the curved shape, a position of a radially outer surface 110*s* of the first fillet 110 is located on the radial inner side. That is, according to the embodiments shown in FIGS. 5A, 5B, and 8, in the meridional cross-section of the impeller 5, for example, as compared with a case where the first end surface 110*a* and the second end surface 110*b* are connected by a plane 190 indicated by a long dashed double-dotted straight line in FIG. 5A, the position of the radially outer surface 110*s* of the first fillet 110 is located on the radially inner side. Thus, as compared with the case without the curved shape as described above, it is possible to reduce the thickness of the first fillet and to suppress the stress generated by the centrifugal force.

In some embodiments, as shown in FIG. 8, at least a part of the first fillet 110 may have a linear shape in the meridional cross-section of the impeller 5.

For example, in the embodiment shown in FIG. 8, the first fillet 110 includes the first curved portion 111, the second curved portion 113, and the straight portion 115. The first curved portion 111 and the second curved portion 113 each have the curved shape in which the center of curvature exists on the radially outer side of the outer peripheral surface 65, in the meridional cross-section of the impeller 5. The straight portion 115 has the linear shape in the meridional cross-section of the impeller 5.

For example, in the embodiment shown in FIG. 8, in the first fillet 110, in the first curved portion 111, the first curved portion 111, the straight portion 115, and the second curved portion 113 are disposed in order from the side of the trailing edge 28 to the side of the outer peripheral surface 65. FIG. 8 shows, by a double-dotted chain line, an assumed case where a virtual arc AR2, in which the center of curvature exists on the radially outer side of the outer peripheral surface 65, connects the first curved portion 111 and the second curved portion 113 in the meridional cross-section of the impeller 5.

Since at least a part of the first fillet 110 has the linear shape in the meridional cross-section of the impeller 5, processing becomes easy when the impeller 5 is formed by cutting work.

Since the centrifugal compressor 2 according to some embodiments includes the impeller 5 according to some embodiments described above, it is possible to increase the compression ratio of the centrifugal compressor 2 while ensuring the durability of the centrifugal compressor 2.

Further, since the turbocharger 1 according to some embodiments includes the above-described centrifugal compressor 2, it is possible to increase the compression ratio of the centrifugal compressor 2 while ensuring the durability of the centrifugal compressor 2.

The present disclosure is not limited to the above-described embodiments, and also includes an embodiment obtained by modifying the above-described embodiments and an embodiment obtained by combining these embodiments as appropriate.

For example, in some embodiments described above, the first fillet 110 is formed for each of all the airfoil portions 7. However, the first fillet 110 may be formed for at least one airfoil portion 7.

Further, in some embodiments described above, the second end surface 110*b* of the first fillet 110 on the side of the outer peripheral surface 65 is located on the front surface side relative to the back surface side-edge portion on the outer peripheral surface 65 of the back plate portion 67. However, the second end surface 110*b* of the first fillet 110 on the side of the outer peripheral surface 65 may be located in the back surface side-edge portion on the outer peripheral surface 65 of the back plate portion 67.

The contents described in the above embodiments would be understood as follows, for instance.

(1) An impeller 5 of a centrifugal compressor 2 according to at least one embodiment of the present disclosure is the impeller 5 of the centrifugal compressor 2, that is, the compressor impeller 5 and includes a hub 6, at least one airfoil portion 7 erected on a hub surface 61 of the hub 6, and a first fillet 110. The at least one airfoil portion 7 has a trailing edge 28 configured such that a distance between the trailing edge 28 and an axis AX of the centrifugal compressor 2 increases with increasing distance from a back surface 63 of the hub 6. The first fillet 110 is formed on a radially outer side of an outer peripheral surface 65 of a back plate portion 67 forming a back surface portion of the hub 6. The first fillet 110 connects the outer peripheral surface 65 of the back plate portion 67 and the trailing edge 28 of the at least one airfoil portion 7.

As described above, in the case where the peripheral speed of the impeller 5 is to be increased by changing the shape of the trailing edge 28 of the airfoil portion 7, simply projecting a part of the trailing edge 28 of the airfoil portion 7 radially outward from the maximum diameter portion of the hub 6 of the impeller 5 may lead to the increase in stress due to the centrifugal force acting on the airfoil portion 7 and the decrease in natural frequency of the airfoil portion 7.

That is, if the vicinity of the trailing edge 28 of the airfoil portion 7 is projected radially outward from the outer peripheral surface 65 of the back plate portion 67, the vicinity of the trailing edge 28 of the airfoil portion 7 is separated from the hub surface 61, which may cause the decrease in natural frequency of the airfoil portion 7. However, with the above configuration (1), since the first fillet 110 connects the trailing edge 28 of the airfoil portion 7 and the outer peripheral surface 65 of the back plate portion 67, it is possible to improve the rigidity of the airfoil portion 7 in the vicinity of the trailing edge 28. Thus, it is possible to suppress the decrease in natural frequency of the airfoil portion 7 while increasing the peripheral speed of the impeller 5.

Further, if the vicinity of the trailing edge 28 of the airfoil portion 7 is projected radially outward from the outer peripheral surface 65 of the back plate portion 67, due to the centrifugal force acting on the portion projecting radially outward from the outer peripheral surface 65 of the back plate portion 67, the stress generated in the airfoil portion 7 increases as compared with the case without the above-described portion. However, with the above configuration (1), since the first fillet 110 can bear a part of the above-described stress, it is possible to suppress the stress on the airfoil portion 7 in the vicinity of the trailing edge 28.

Therefore, with the above configuration (1), it is possible to ensure the durability of the impeller 5 while increasing the peripheral speed of the impeller 5.

Further, with the above configuration (1), in the case where the impeller 5 is manufactured by machining, it is possible to mitigate the sudden change in angle from the trailing edge 28 to the outer peripheral surface 65 of the back plate portion 67 when cutting from the trailing edge 28 to the outer peripheral surface 65 of the back plate portion 67, facilitating processing.

(2) In some embodiments, in the above configuration (1), the impeller 5 further includes a second fillet 82 connecting the hub surface 61 and a suction surface 71 of the airfoil portion 7, and a third fillet 83 connecting the hub surface 61 and a pressure surface 72 of the airfoil portion 7. The first fillet 110 includes a fillet portion on suction surface 102 connecting the second fillet 82 and the outer peripheral surface 65 of the back plate portion 67, and a fillet portion on pressure surface 103 connecting the third fillet 83 and the outer peripheral surface 65 of the back plate portion 67.

As described above, if the vicinity of the trailing edge 28 of the airfoil portion 7 is projected radially outward from the outer peripheral surface 65 of the back plate portion 67, due to the centrifugal force acting on the portion projecting radially outward from the outer peripheral surface 65 of the back plate portion 67, the stress generated in the airfoil portion 7 increases as compared with the case without the above-described portion. However, with the above configuration (2), since the fillet portion on suction surface 102 and the fillet portion on pressure surface 103 can also bear a part of the above-described stress, it is possible to further suppress the stress on the airfoil portion 7 in the vicinity of the trailing edge 28.

Further, with the above configuration (2), since the first fillet 110 includes the fillet portion on suction surface 102 and the fillet portion on pressure surface 103, it is possible to further improve the rigidity of the airfoil portion 7 in the vicinity of the trailing edge 28. Thus, it is possible to further suppress the decrease in natural frequency of the airfoil portion 7.

(3) In some embodiments, in the above configuration (2), a circumferential length of the fillet portion on pressure surface 103 is greater than a circumferential length of the fillet portion on suction surface 102.

In the case where the impeller 5 is manufactured by machining, if the airfoil portion 7 is formed to be inclined toward the side of the pressure surface 72, it is easy to insert the tool used for cutting between the hub surface 61 and the suction 71 surface of the airfoil portion 7, but it is difficult to insert the tool between the hub surface 61 and the pressure surface 72 of the airfoil portion 7. Thus, despite the attempt to reduce the thickness of the second fillet 82 and the third fillet 83 as much as possible, the third fillet 83 is more likely to remain thick than the second fillet 82, and the circumferential length of the third fillet 83 is likely to be greater than that of the second fillet 82. Therefore, if the fillet portion on suction surface 102 and the fillet portion on pressure surface 103 are respectively formed in accordance with the shapes of the second fillet 82 and the third fillet 83, it is likely to obtain the above configuration (3). Conversely, on the contrary to the above configuration (3), in order to make the circumferential length of the fillet portion on pressure surface 103 less than the circumferential length of the fillet portion on suction surface 102, it takes time and effort for processing. Therefore, with the above configuration (3), processing becomes easy.

(4) In some embodiments, in the above configuration (2) or (3), the airfoil portion 7 includes a first airfoil portion 7A and a second airfoil portion 7B adjacent to the first airfoil portion 7A at an interval in a circumferential direction on a side of the suction surface 71 of the first airfoil portion 7A. The impeller 5 further includes an inter-airfoil fillet 105 which connects the fillet portion on suction surface 102 formed on the side of the suction surface 71 of the first airfoil portion 7A and the fillet portion on pressure surface 103 formed on a side of the pressure surface 72 of the second airfoil portion 2B, on an outer peripheral side of the back plate portion 67.

In a case where the impeller 5 is formed by cutting work, if the outer circumference is cut while rotating the impeller 5 around the axis AX, the inter-airfoil fillet 105 is also formed in the outer peripheral portion of the back plate portion 67 when the first fillet 110 is formed. If the inter-airfoil fillet 105 is not provided, it is necessary to remove the inter-airfoil fillet 105 by cutting or the like in the case where the inter-airfoil fillet 105 is formed as described above.

Therefore, with the above configuration (4), the impeller 5 is processed easily as compared with the case without the inter-airfoil fillet 105.

(5) In some embodiments, in any one of the above configurations (1) to (4), at least a part of the first fillet 110 has a linear shape in a meridional cross-section of the impeller 5.

With the above configuration (5) having the above-described linear shape, processing becomes easy when the impeller 5 is formed by cutting work.

(6) In some embodiments, in any one of the above configurations (1) to (5), at least a part of the first fillet 110 has a curved shape in which a center of curvature exists on a radially outer side of the outer peripheral surface 65, in a meridional cross-section of the impeller 5.

With the above configuration (6), having the above-described curved shape, as compared with the case without the above-described curved shape, the position of the radially outer surface 110*s* of the first fillet 110 is located on the radial inner side. Thus, as compared with the case without the above-described curved shape, it is possible to reduce the thickness of the first fillet 110 and to suppress the stress generated by the centrifugal force.

(7) A centrifugal compressor 2 according to at least one embodiment of the present disclosure includes the impeller 5 of the centrifugal compressor 2 according to any one of the above configurations (1) to (6), and a compressor housing 10 for housing the impeller.

With the above configuration (7), including the impeller 5 of the centrifugal compressor 2 according to any one of the above configurations (1) to (6), it is possible to increase the compression ratio of the centrifugal compressor 2 while ensuring the durability of the centrifugal compressor 2.

(8) A turbocharger 1 according to at least one embodiment of the present disclosure includes the centrifugal compressor 2 according to the above configuration (7).

With the above configuration (8), including the centrifugal compressor 2 according to the above configuration (7), it is possible to increase the compression ratio of the centrifugal compressor 2 while ensuring the durability of the centrifugal compressor 2.

REFERENCE SIGNS LIST

1 Turbocharger
2 Centrifugal compressor
5 Compressor impeller (impeller)
6 Hub
7 Airfoil portion (airfoil)
7A First airfoil portion
7B Second airfoil portion
10 Compressor housing
26 Leading edge
28 Trailing edge
61 Hub surface
63 Back surface

65 Outer peripheral surface
67 Back plate portion
71 Suction surface
72 Pressure surface
82 Second fillet
83 Third fillet
102 Fillet portion on suction surface
103 Fillet portion on pressure surface
105 Inter-airfoil fillet
110 First fillet

The invention claimed is:

1. An impeller of a centrifugal compressor, comprising:

a hub;

at least one airfoil portion erected on a hub surface of the hub, the at least one airfoil portion having a trailing edge configured such that a distance between the trailing edge and an axis of the centrifugal compressor increases with increasing distance from a back surface of the hub; and a first fillet which is formed on a radially outer side of an outer peripheral surface of a back plate portion forming a back surface portion of the hub, the first fillet connecting the outer peripheral surface and the trailing edge of the at least one airfoil portion, wherein the first fillet has a curved portion having a center of curvature exists on a radially outer side of the outer peripheral surface, in a meridional cross-section of the impeller, and wherein an end edge of the curved portion on a side of the outer peripheral surface is located at the back plate portion.

2. The impeller of the centrifugal compressor according to claim 1, further comprising:

a second fillet connecting the hub surface and a suction surface of the airfoil portion; and a third fillet connecting the hub surface and a pressure surface of the airfoil portion, wherein the first fillet includes:

a fillet portion on suction surface connecting the second fillet and the outer peripheral surface of the back plate portion; and a fillet portion on pressure surface connecting the third fillet and the outer peripheral surface of the back plate portion.

3. The impeller of the centrifugal compressor according to claim 2, wherein a circumferential length of the fillet portion on pressure surface is greater than a circumferential length of the fillet portion on suction surface.

4. The impeller of the centrifugal compressor according to claim 2, wherein the airfoil portion includes a first airfoil portion and a second airfoil portion adjacent to the first airfoil portion at an interval in a circumferential direction on a side of the suction surface of the first airfoil portion, and wherein the impeller of the centrifugal compressor further comprises an inter-airfoil fillet which connects the fillet portion on suction surface formed on the side of the suction surface of the first airfoil portion and the fillet portion on pressure surface formed on a side of the pressure surface of the second airfoil portion, on an outer peripheral side of the back plate portion.

5. The impeller of the centrifugal compressor according to claim 1, wherein at least a part of the first fillet has a linear shape in a meridional cross-section of the impeller.

6. A centrifugal compressor, comprising:

the impeller of the centrifugal compressor according to claim 1; and a compressor housing for housing the impeller.

7. A turbocharger, comprising:

the centrifugal compressor according to claim 6.

* * * * *